US009587377B2

(12) United States Patent
Lee

(10) Patent No.: US 9,587,377 B2
(45) Date of Patent: Mar. 7, 2017

(54) RAISED COUNTERWEIGHT FOR A MINING MACHINE

(71) Applicant: Harnischfeger Technologies, Inc., Wilmington, DE (US)

(72) Inventor: Mooyoung Lee, Milwaukee, WI (US)

(73) Assignee: Harnischfeger Technologies, Inc., Wilmington, DE (US)

( * ) Notice: Subject to any disclaimer, the term of this patent is extended or adjusted under 35 U.S.C. 154(b) by 0 days.

(21) Appl. No.: 14/616,287

(22) Filed: Feb. 6, 2015

(65) Prior Publication Data

US 2016/0230368 A1 Aug. 11, 2016

(51) Int. Cl.

| | |
|---|---|
| ***E02F 9/18*** | (2006.01) |
| ***E02F 3/30*** | (2006.01) |
| ***E02F 9/14*** | (2006.01) |
| ***E02F 3/48*** | (2006.01) |
| ***E02F 3/58*** | (2006.01) |

(52) U.S. Cl.

CPC ..... *E02F 9/18* (2013.01); *E02F 3/30* (2013.01); *E02F 3/48* (2013.01); *E02F 3/58* (2013.01); *E02F 9/14* (2013.01)

(58) Field of Classification Search

CPC ..... E02F 9/18

See application file for complete search history.

(56) References Cited

U.S. PATENT DOCUMENTS

| | | | | |
|---|---|---|---|---|
| 2,173,341 A | | 9/1939 | Penglase | |
| 3,653,486 A | * | 4/1972 | McLean | E02F 9/18 414/719 |
| 3,902,735 A | | 9/1975 | Bertram et al. | |
| 3,963,133 A | * | 6/1976 | Gilli | E02F 9/18 414/719 |
| 4,004,696 A | * | 1/1977 | Briggs | E02F 9/18 414/719 |
| 4,557,390 A | | 12/1985 | Mick | |
| 5,156,215 A | | 10/1992 | Jensen | |
| 5,192,180 A | * | 3/1993 | Kolleth | E02F 9/24 414/719 |

(Continued)

FOREIGN PATENT DOCUMENTS

| | | |
|---|---|---|
| DE | 19717567 | 10/1997 |

OTHER PUBLICATIONS

Rusinski et al., "An analysis of the causes of a BWE counterweight boom support fracture," <http://sciencedirect.com/science/article/pii/S1350630709001460> Jan. 2010, pp. 179-191 vol. 17 No. 1 ISSN: 1350-6307; accessed Jan. 17, 2017, enlarged Fig. 1.*

(Continued)

*Primary Examiner* — Gerald McClain

(74) *Attorney, Agent, or Firm* — Michael Best & Friedrich LLP

(57) ABSTRACT

A mining shovel includes a base, a revolving frame coupled to the base and rotatable about an axis, a boom pivotally coupled to the revolving frame, a handle coupled to the boom, and a dipper coupled to the handle. The dipper has a dipper door, and is located at a front end of the shovel. A counterweight having a center of gravity is disposed at the rear end of the shovel to balance the shovel, and is supported by a truss structure that is coupled to the revolving frame, such that the center of gravity is disposed above the revolving frame.

10 Claims, 4 Drawing Sheets

(56) References Cited

U.S. PATENT DOCUMENTS

| | | | | |
|---|---|---|---|---|
| 5,533,284 | A | 7/1996 | Esch | |
| 6,131,751 | A * | 10/2000 | Pech | B66C 23/36 212/178 |
| 6,296,436 | B1 | 10/2001 | Ramun | |
| 6,394,212 | B1 | 5/2002 | Takano et al. | |
| 7,162,816 | B2 | 1/2007 | Otsuka et al. | |
| 7,213,871 | B2 | 5/2007 | Yamamoto | |
| 7,546,928 | B2 * | 6/2009 | Pech | B66C 23/76 212/196 |
| 7,857,083 | B2 | 12/2010 | Oyamada et al. | |
| 7,959,219 | B2 | 6/2011 | Namura et al. | |
| 7,967,158 | B2 * | 6/2011 | Pech | B66C 23/76 212/178 |
| 8,069,592 | B2 | 12/2011 | Ellett | |
| 8,287,033 | B2 | 10/2012 | Yamamoto et al. | |
| 8,523,226 | B2 | 9/2013 | Yoshimoto et al. | |
| 8,820,457 | B2 | 9/2014 | Nishimura | |
| 2010/0290883 | A1 | 11/2010 | Kitatani et al. | |
| 2012/0195729 | A1 | 8/2012 | Hren et al. | |
| 2013/0259626 | A1 | 10/2013 | Larson et al. | |
| 2013/0343853 | A1 | 12/2013 | Sato et al. | |

OTHER PUBLICATIONS

PCT/US2016/016863 International Search Report and Written Opinion dated Apr. 22, 2016 (13 pages).

Rusinski et al., "An analysis of the causes of a BWE counterweight boom support fracture," <http://aciencedirect.com/science/article/pii/S1350630709001460> Jan. 2010, pp. 179-191 vol. 17 No. 1 ISSN: 1350-6307.

* cited by examiner

RAISED COUNTERWEIGHT FOR A MINING MACHINE

FIELD OF THE INVENTION

The present invention relates to counterweights, and more particularly, to an improved counterweight system for an industrial machine.

BACKGROUND OF THE INVENTION

In the mining field, and in other fields in which large volumes of material are collected and removed from a work site, it is typical to employ industrial machines that include large dippers for shoveling the material from the work site. Industrial machines, such as electric rope or power shovels, draglines, etc., are used to execute digging operations to remove the material from, for example, a bank of a mine. These industrial machines generally include counterweight structures added to the rear end of the machine, the counterweight structures being used to balance the machine during operations of the machine.

The current counterweight structures of many industrial machines include counterweight casting slabs bolted and/or welded to a lower, rear end of a counterweight box. When the shovel rotates, the counterweight creates a tail swing radius. This radius defines an outer boundary that a secondary machine (e.g., a loading vehicle) may not enter. If the loading vehicle enters this area, it may be damaged by or damage the shovel.

The current counterweight structures also present a problem for overall weight of the machine. Since the counterweight creates a tail swing radius, most counterweights have a lateral distance from the rear end of the shovel capped to minimize tail swing. Since the center of gravity of the counterweight is close to the center of gravity of the shovel, the moment arm for balance of the machine is relatively small, meaning the weight of the counterweight must be increased to effectively balance the machine. For example, in some instances, the weight of the counterweight is above 23% of the overall shovel weight. This creates a higher total machine weight, and most components of the machine experience higher degrees of stress as a result.

SUMMARY OF THE INVENTION

In accordance with one construction, a mining shovel includes a base, a revolving frame coupled to the base and rotatable about an axis, a boom pivotally coupled to the revolving frame, a handle coupled to the boom, and a dipper coupled to the handle. The dipper has a dipper door, and is located at a front end of the shovel. A counterweight having a center of gravity is disposed at the rear end of the shovel to balance the shovel, and is supported by a truss structure that is coupled to the revolving frame, such that the center of gravity is disposed above the revolving frame.

In accordance with another construction, a mining shovel includes a base, a revolving frame coupled to the base and rotatable about an axis, a boom pivotally coupled to the revolving frame, a handle coupled to the boom, and a dipper coupled to the handle. The dipper has a dipper door, and is located at a front end of the shovel. The mining shovel also includes a gantry tension member coupled to the frame, a gantry compression member coupled to the frame, and a tension cable coupled to both the gantry tension member and the gantry compression member at a gantry junction, the tension cable also coupled to the boom. A counterweight is disposed at the rear end of the shovel. A triangular truss structure is coupled to the frame and supports the counterweight. The gantry tension member comprises one of three members of the triangular truss structure Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
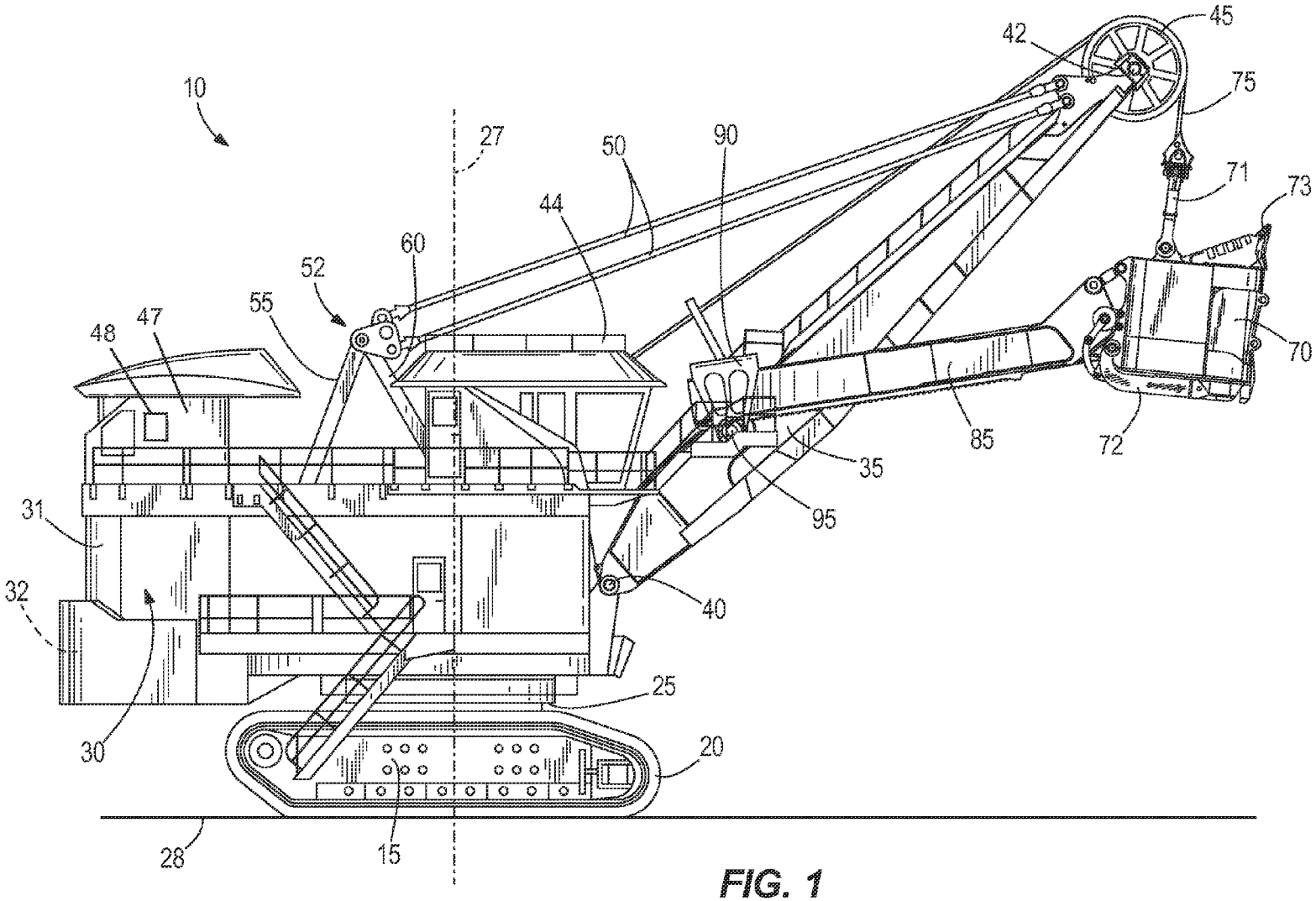
FIG. 1 is a side view of an industrial machine, illustrating a conventional counterweight system on the industrial machine.

FIG. 1 illustrates a power shovel 10. Although the counterweight systems described herein are described in the context of a power shovel, the counterweight systems can be applied to, performed by, or used in conjunction with a variety of industrial machines (e.g., draglines, shovels, tractors, etc.).

The shovel 10 includes a mobile base 15, drive tracks 20, a turntable 25, a revolving frame 30 including a rear room 31, a conventional counterweight system 32 (e.g., with large compartments and metal slabs placed inside to add weight to the back of the shovel 10) attached to a lower rear end of the revolving frame 30, a boom 35, a lower end 40 of the boom 35 (also called a boom foot), an upper end 42 of the boom 35 (also called a boom point), a front cab 44 disposed above the frame 30, a rear cab 47 disposed above the frame 30, tension cables 50, a gantry tension member 55 coupled to the frame 30, a gantry compression member 60 coupled to the frame 30, a dipper 70 having a door 72 and teeth 73, a hoist rope 75, a hoist drum (not shown), a dipper handle 85, a saddle block 90, a shipper shaft 95, and a transmission unit (also called a crowd drive, not shown). The turntable 25 allows rotation of the upper frame 30 relative to the lower base 15. The turntable 25 defines a rotational or swing axis 27 of the shovel 10. The rotational axis 27 is perpendicular to a plane 28 defined by the base 15 and generally corresponds to a grade of the ground or support surface.

The mobile base 15 is supported by the drive tracks 20. The mobile base 15 supports the turntable 25 and the revolving frame 30. The turntable 25 is capable of 360-degrees of rotation relative to the mobile base 15. The boom 35 is pivotally connected at the lower end 40 to the revolving frame 30. The boom 35 is held in an upwardly and outwardly extending relation to the revolving frame 30 by the tension cables 50, which are anchored to the gantry tension member 55 and the gantry compression member 60 at a gantry junction 52. The gantry compression member 60 is mounted on the revolving frame 30, and a sheave 45 is rotatably mounted on the upper end 42 of the boom 35.

The dipper 70 is suspended from the boom 35 by the hoist rope 75. The hoist rope 75 is wrapped over the sheave 45 and attached to the dipper 70 at a bail 71. The hoist rope 75 is anchored to the hoist drum (not shown) of the revolving frame 30. The hoist drum is driven by at least one electric motor (not shown) that incorporates a transmission unit (not shown). As the hoist drum rotates, the hoist rope 75 is paid out to lower the dipper 70 or pulled in to raise the dipper 70. The dipper handle 85 is also coupled to the dipper 70. The dipper handle 85 is slidably supported in the saddle block 90, and the saddle block 90 is pivotally mounted to the boom 35 at the shipper shaft 95. The dipper handle 85 includes a rack and tooth formation thereon that engages a drive pinion (not shown) mounted in the saddle block 90. The drive pinion is driven by an electric motor and transmission unit (not shown) to extend or retract the dipper handle 85 relative to the saddle block 90.

An electrical power source (not shown) is mounted to the revolving frame 30 to provide power to a hoist electric motor (not shown) for driving the hoist drum, one or more crowd electric motors (not shown) for driving the crowd transmission unit, and one or more swing electric motors (not shown) for turning the turntable 25. Each of the crowd, hoist, and swing motors is driven by its own motor controller, or is alternatively driven in response to control signals from a controller (not shown).

Figure 2:
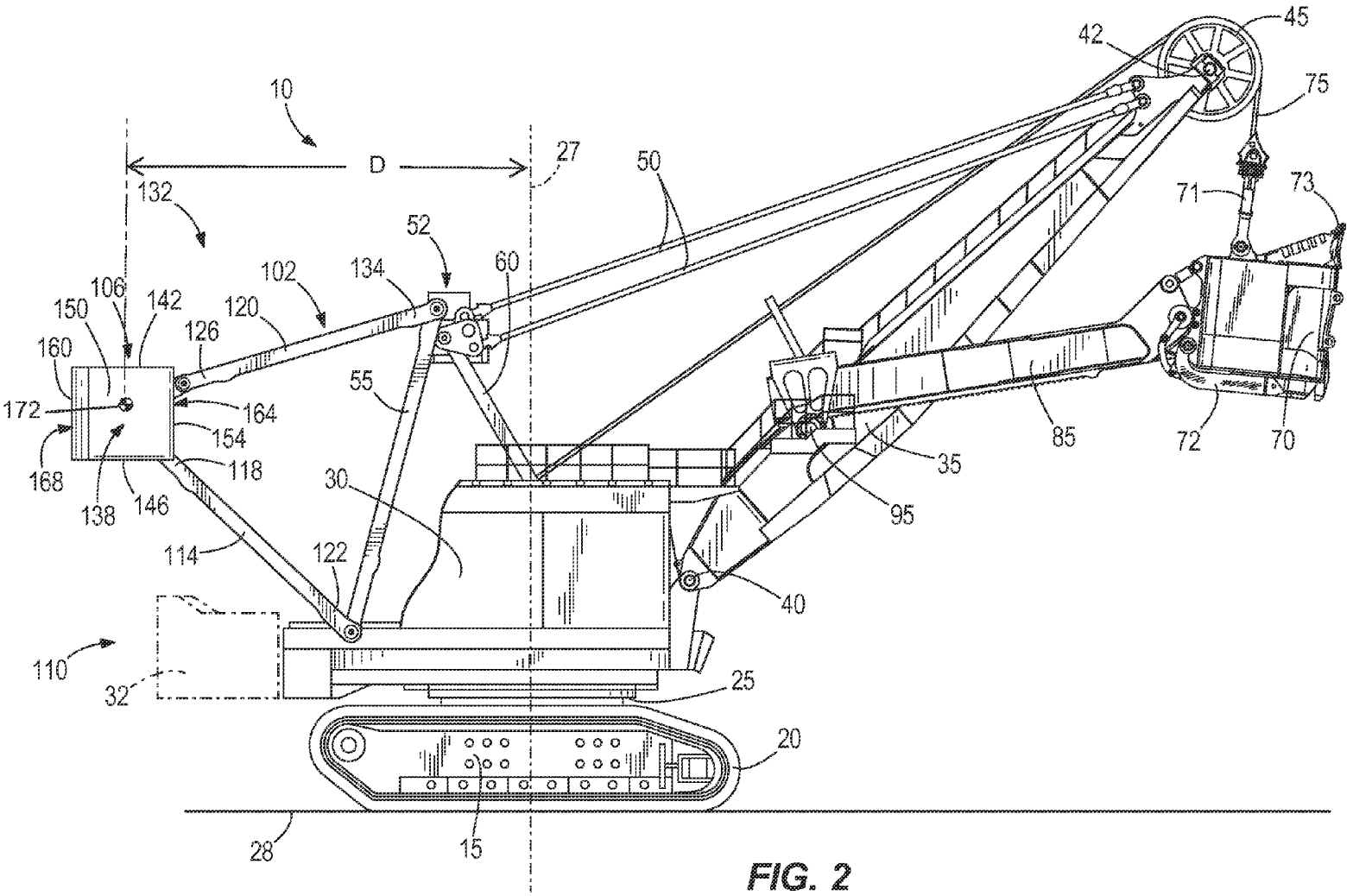
FIG. 2 is a partial side view of an industrial machine according to one construction of the invention, with a raised counterweight system used in place of the conventional counterweight system.
Figure 3:
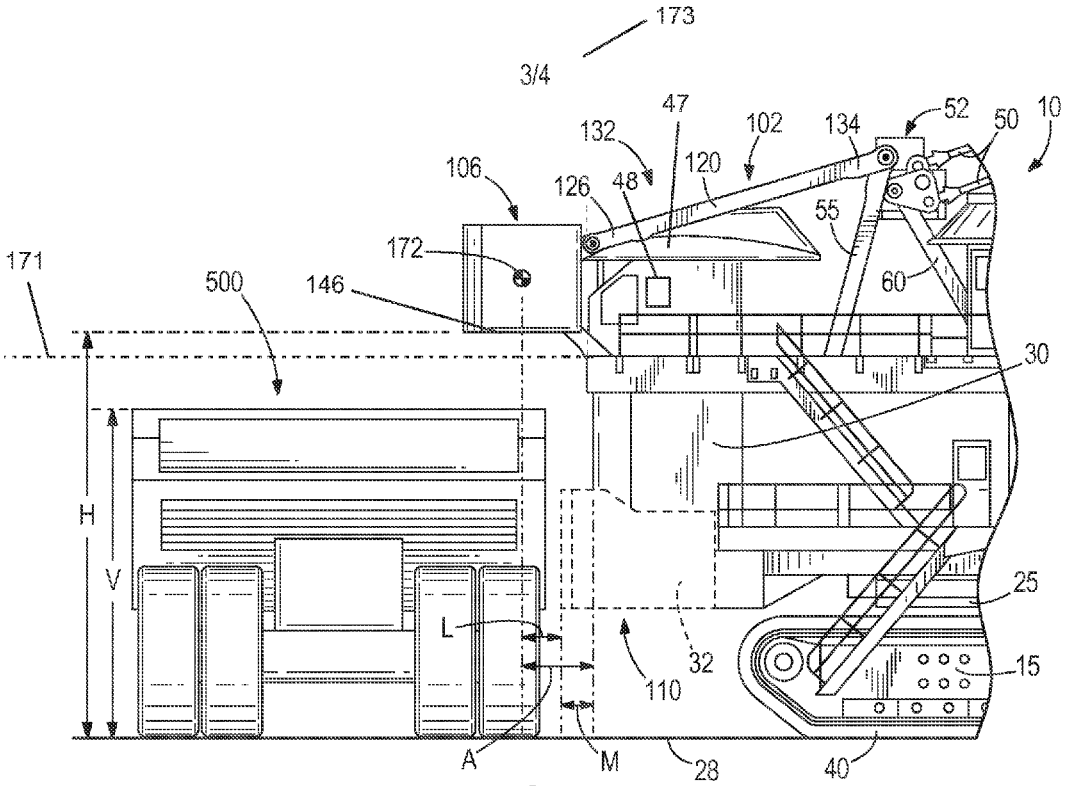
FIG. 3 is a partial side view of the industrial machine of FIG. 2, and also a rear view of a transport vehicle disposed behind the industrial machine.
Figure 4:
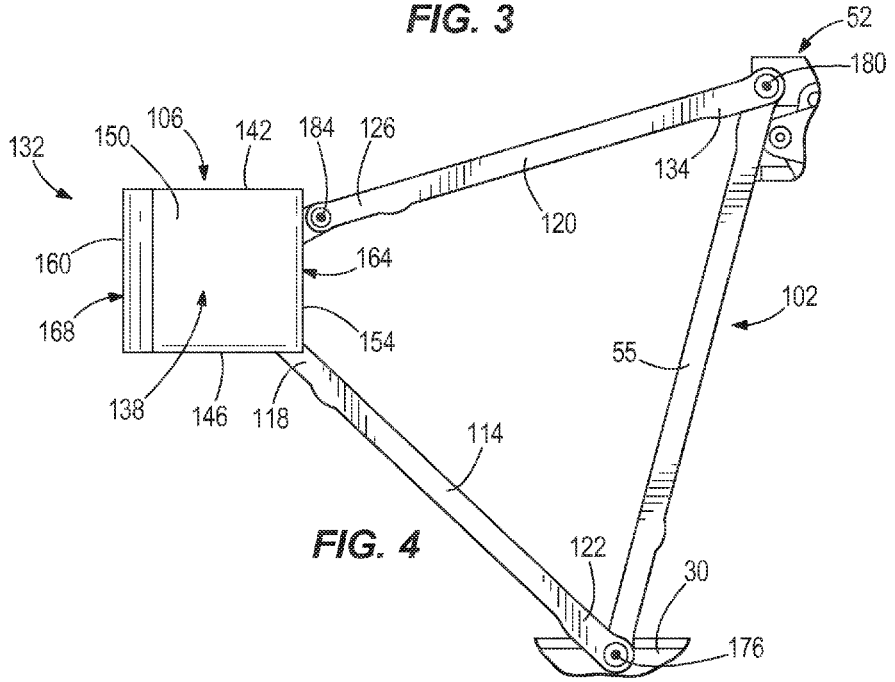
FIG. 4 is a side view of a portion the raised counterweight system of FIGS. 2 and 3.

FIGS. 2-4 illustrate an improved counterweight system 132 according to one construction for use with the shovel 10. In some constructions the counterweight system 132 entirely replaces the conventional counterweight system 32 (shown in dashed lines in FIGS. 2 and 3). The counterweight system 132 includes a truss structure 102 and a counterweight 106 coupled to the truss structure 102. The truss structure 102 is coupled to the revolving frame 30 and supports the counterweight 106. The truss structure 102 elevates the counterweight 106 and extends the counterweight 106 rearwardly over a back portion 110 of the shovel 10.

FIG. 2 illustrates the shovel 10 with a section of the revolving frame 30 removed to show the truss structure 102. The truss structure 102 includes a first member 114, a second member 120, and the gantry tension member or third member 55. The first member 114 is coupled to the counterweight 106 at a first end 118, and is coupled to the revolving frame 30 and the third member 55 at a second end 122. The second member 120 is coupled to the counterweight 106 at a first end 126, and is coupled to the gantry junction 52 and the third member 55 at a second end 134. As shown in FIG. 2, this forms a substantially triangular structure to elevate and support the counterweight 106. In other constructions the number and arrangement of members in the truss structure 102 varies. For example, in some constructions the truss structure 102 includes four members, as opposed to three members, that are joined together in a quadrilateral configuration. By elevating and laterally extending the counterweight 106, the truss structure 102 acts to reduce the stresses acting on the gantry tension member 55 and the gantry compression member 60. The counterweight 106 counteracts the force of the tension cables 50 on the gantry junction 52, thus resolving a component of that force onto the second member 120 and relieving forces from the gantry tension member 55 and the gantry compression member 60.

With continued reference to FIG. 2, in the illustrated construction the counterweight 106 includes a body or counterweight box 138 defining a cavity inside for holding counterweight units (e.g., metal slabs). The counterweight box 138 includes a top wall 142, a bottom wall 146, a first side wall 150, a second side wall (not shown), a front wall 154, a back wall 160, and in some constructions one or more internal walls (not shown). In the illustrated construction, the top wall 142 and the bottom wall 146 are coupled (e.g. welded and/or bolted) to the side walls, the front wall 154, and the back wall 160. The counterweight box 138 defines a first, front end 164 and a second, back end 168, the first, front end 164 being positioned closer to the rotational axis (e.g., swing axis) 27 of the shovel 10 than the second, back end 168. In some constructions, the internal walls extend along a direction from the back wall 160 to the front wall 154.

In yet other constructions, the counterweight 106 is a single body (e.g., a large solid or hollowed-out piece of material) that is detachably or fixedly coupled to the truss structure 102. In some constructions the counterweight 106 is a cast piece, or a plate.

FIG. 3 illustrates a rear section of the shovel 10 with the counterweight system 132 elevating the counterweight 106 a height H above the plane 28 (the height H being measured perpendicular to the plane 28, and between the plane 28 and the bottom wall 146 of the counterweight 106). In the illustrated construction, the height H is about 32 feet, which is larger than a height V of a vehicle 500 (the height V also being measured perpendicularly relative to the plane 28). The height H places the counterweight 106 entirely above the rotating frame 30. For example, as illustrated in FIG. 3, the frame 30 extends as high (along a direction perpendicular to the plane 28) as a plane 171. The plane 171 is parallel to the plane 28. The counterweight 106 is disposed entirely above the plane 171. In some constructions the counterweight 106 is always disposed entirely above the plane 171. The counterweight 106 also includes a center of gravity 172. In some constructions, the center of gravity 172 is disposed (e.g., always disposed) above the plane 171. In some constructions, a portion of the counterweight 106 is disposed below the plane 171.

With continued reference to FIG. 3, in the illustrated construction the counterweight 106 is disposed entirely behind the rear cab 47, as well as an air filtration unit 48. The air filtration unit 48, shown schematically in FIG. 3, is disposed on the rear cab 47. In some constructions, the center of gravity 172 is disposed behind both the rear cab 47 and the air filtration unit 48, while a portion of the counterweight 106 is not disposed behind the rear cab 47 or the air filtration unit 48. In the illustrated construction the counterweight 106 is disposed directly behind the rear cab 47 and air filtration unit 48.

With continued reference to FIG. 3, in the illustrated construction, the counterweight 106 is disposed entirely behind the frame 30. For example, the frame 30 extends as far back (i.e., rearwardly) as a plane 173. The plane 173 extends perpendicular to the plane 28. The counterweight 106 is disposed entirely behind the plane 173. In some constructions, the counterweight 106 is always disposed entirely behind the plane 173. In some constructions, the center of gravity 172 is disposed (e.g., always disposed) behind the plane 173. In some constructions, a portion of the counterweight 106 is disposed in front of the plane 173.

In the illustrated construction, the vehicle 500 is a typical mining truck used to collect material from the mining machine 10. For example, during use, in some constructions, the turntable 25 rotates the dipper 70 about the axis 27 to dump material out of the dipper 70 into the back of the vehicle 500, and then rotates back again. Other constructions include different heights for the height H to place the counterweight 106 above the vehicle 500. In further constructions the height H is between approximately 30 feet and 34 feet, or is between approximately 28 feet and 36 feet. Because the height H is larger than the height V of the vehicle 500, the counterweight 106 does not contact or engage with the vehicle 500 during operation (e.g., during rotational movement) or during rest of the shovel 10, and instead stays above the vehicle 500.

With continued reference to FIG. 3, in the illustrated construction, the center of gravity 172 of the counterweight 106 is disposed rearward of a lower portion the rotating frame 30 by a distance A, and is disposed rearward of a prior location of the removed conventional counterweight 32 by a distance L. By removing the conventional counterweight 32 and using the counterweight 106 instead, an additional distance M (e.g., 2 feet in some constructions) is added, creating added space for the vehicle 500 to be moved even closer to the mining shovel 10.

With continued reference to FIGS. 2 and 3, because the counterweight 106 is disposed generally rearward of the rotating frame 30, a moment arm distance D (FIG. 2) and a moment force created by the counterweight 106 about the axis of rotation 27 of the shovel 10 are greater than if the counterweight 106 were spaced closer to the rotating frame 30 and to the axis 27. The moment force created by the counterweight 106 acts to balance a moment force created by the dipper 70 about the axis 27. In some constructions, because of the rearward location of the counterweight 106, the weight of the counterweight 106 (and consequently the shovel 10) can be reduced as compared with conventional counterweights, while still maintaining the same moment force.

With reference to FIG. 2, in the illustrated construction, the counterweight 106 has a weight between approximately 500,000 lbs. and 1,000,000 lbs. In some constructions, the counterweight 106 has a weight of approximately 677,000 lbs. In some constructions, the counterweight 106 has a weight of approximately 783,000 lbs. With continued reference to FIG. 2, the moment arm distance D is a distance between the center of gravity 172 of the counterweight 106 and the axis of rotation 27. In the illustrated construction the moment arm distance D is between approximately 26 feet and 34 feet. In some constructions, the moment arm distance D is approximately 30 feet. In other constructions, the weight of the counterweight 106 and the moment arm distance D are greater or less than the values and ranges presented above.

In some constructions, the counterweight 106 has a weight of between approximately 400,000 lbs. and 800,000 lbs., and a moment force generated by the counterweight 106 (i.e., a force generated by the weight of the counterweight 106 multiplied by the moment arm distance D) is between approximately 15,000,000 ft.-lbs. and 30,000,000 ft.-lbs. Other constructions include different ranges of values for the weights and moment forces.

FIG. 4 illustrates an enlarged view of the truss structure 102 of FIG. 2, detailing the coupling of the truss members 55, 114, 120. In the illustrated construction a first pin 176 couples the second end 122 of the first member 114 and the third member 55 to the revolving frame 30. A second pin 180 couples the second end 134 of the second member 120 and the third member 55 to the gantry junction 52. A third pin 184 couples the first end 126 of the second member 120 to the counterweight 106. In the illustrated construction, the first end 118 of the first member 114 is coupled directly (e.g., fixedly attached) to the counterweight 106. The pins 176, 180, 184 permit some pivoting and relative motion between the truss members 55, 114, 120. In other constructions various other manners of coupling the truss members are used (e.g., welding, bolting, etc.).

Figure 4A:
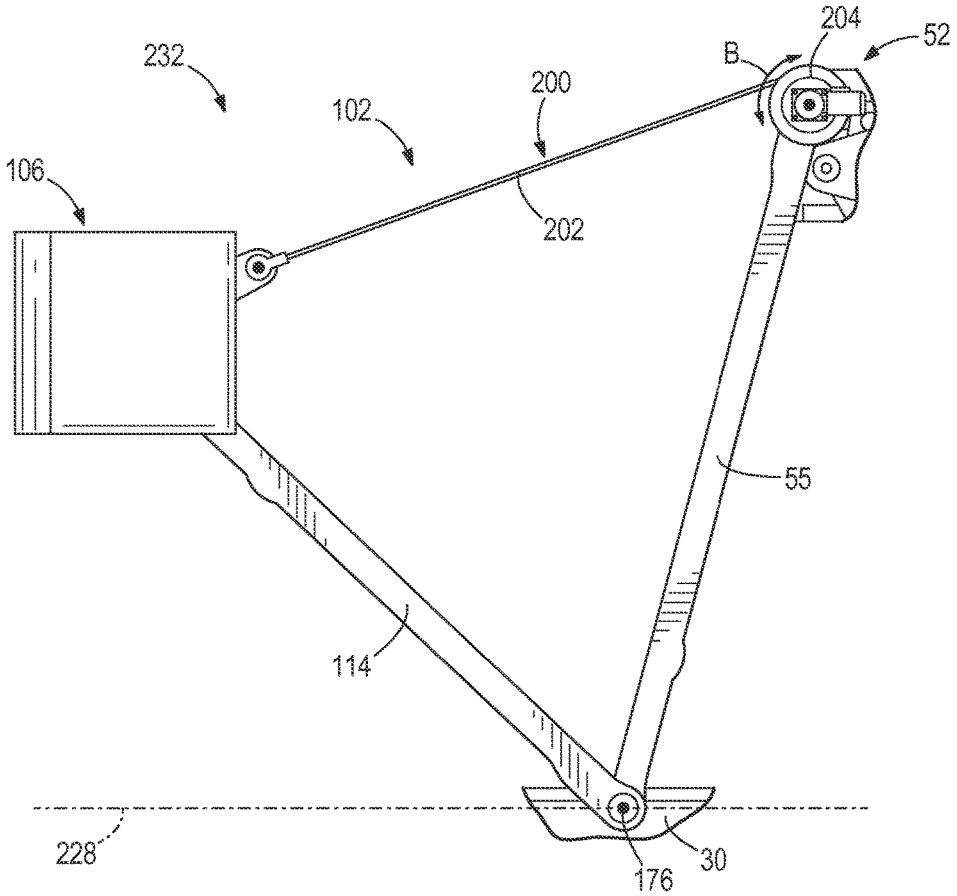
FIG. 4A is a side view of a portion of a counterweight system according to another construction for use on the industrial machine of FIGS. 2-4.

FIG. 4A illustrates a counterweight system 232 according to another construction of the invention. The counterweight system 232 is similar to the counterweight system 132; however, in the counterweight system 232, an adjustment mechanism 200 is used to change a position of the counterweight 106. In the illustrated construction the adjustment mechanism 200 is a pulley system that includes a line (e.g., cable, wire, rope, etc.) 202 coupled to an actuator 204 (e.g., a power-operated sheave or winch), the actuator 204 being coupled to the gantry junction 52. The length of the line 202 is varied by the actuator 204, for example by rotating the actuator 204 in the directions denoted by arrows B in FIG. 4A. In other constructions, the adjustment mechanism 200 includes extensible hydraulic or pneumatic cylinders, a rack and pinion, or any other device suitable for the purpose of varying the length of a line and for altering a position of the counterweight 106. In some constructions the line 202 is coupled directly to the hoist drum, and acts to balance at least a portion of the dipper 70.

With continued reference to FIG. 4A, as with the counterweight system 132 illustrated in FIG. 4, the first member 114 is pivotally coupled to the revolving frame 30 and the third member 55 of the truss structure 102 at the first pin 176. This permits the counterweight 106 and the first member 114 to pivot about the pin 176 as the adjustment mechanism 200 adjusts the length of the line 202. The first member 114 is fixedly attached to the counterweight 106. In other constructions, the first member 114 is pivotally connected at a fourth pin to the counterweight 106 to allow for rotation of the counterweight 106 about the fourth pin if desired. In the illustrated construction, the first member 114 and the counterweight 106 are rotatable between approximately 45° (e.g., as seen in FIG. 4A) and 90° with respect to an axis 228 that is parallel to the plane 28. Other constructions include other ranges of angles and movement of the counterweight 106. In some constructions, the first member 114 and the counterweight 106 are pivotable about the pin 176, but the counterweight 106 always remains at least at the height H illustrated in FIG. 3, and at all times above the frame 30.

In operation, the length of the line 202 may be varied for multiple purposes. For example, while the shovel 10 performs a digging operation and the dipper 70 is extended forward, the moment force produced by the counterweight 106 maintains stability and prevents tipping of the shovel 10. In this situation, the length of the line 202 may be extended by the actuator to increase a moment arm between counterweight 106 and the axis 27. This effectively increases the force acting to balance the shovel 10 without requiring any increase in weight of the counterweight 106. Once a digging operation is complete, it may be desirable to rotate the revolving frame 30 about the turntable 25 to, for example, load excavated material into the vehicle 500. In this situation, it may be advantageous to decrease the length of the line 202 with the actuator to decrease the distance between the counterweight 106 and the axis 27, particularly if the dipper 70 is moved closer to the axis 27.

The adjustment mechanism 200 may also be used to adjust a swing inertia of the shovel 10 as the shovel 10 rotates (e.g., by changing the moment arm of the counterweight 106), thus altering the amount of energy required to accelerate and decelerate the revolving frame 30. For example, as the moment arm of the counterweight 106 is increased (e.g., with adjustment mechanism 200), the swing inertia increases by a square of the added distance. The adjustment mechanism 200 can therefore be used to both adjust the swing inertia as desired for the shovel 10, as well as adjust a moment generated by the counterweight 106 for balancing the shovel 10.

Although the invention has been described in detail with reference to certain preferred embodiments, variations and modifications exist within the scope and spirit of one or more independent aspects of the invention as described.

What is claimed is:

1. A mining shovel comprising:

a base configured to be supported on a ground or support surface, the ground or support surface defining a plane;

a revolving frame coupled to the base and rotatable about an axis, the revolving frame having a top positioned at a first height measured along a direction perpendicular to the plane;

a boom pivotally coupled to the revolving frame;

a handle coupled to the boom;

a dipper coupled to the handle at a front end of the mining shovel, the dipper including a dipper door;

a counterweight disposed at a rear end of the mining shovel, the counterweight including a center of gravity at a second height measured along the direction; and a truss structure coupled to the revolving frame, wherein the truss structure supports the counterweight such that the second height is greater than the first height, wherein the truss structure includes a first member, a second member, and a third member, the first and second members both coupled to the counterweight, wherein the first member is coupled to the counterweight and is pivotally coupled to both the revolving frame and the third member at a pivot point on the revolving frame, and wherein the mining shovel includes an adjustment machanism having an actuator that pivots the counterweight about the picvot point independently of the boom pivoting relative to the revolving frame.

2. The mining shovel of claim 1, wherein the entire counterweight is disposed above the rotating frame along the direction.

3. The mining shovel of claim 1, wherein the direction is a first direction, and wherein the center of gravity is disposed behind the revolving frame along a second direction that is perpendicular to the first direction.

4. The mining shovel of claim 3, wherein the entire counterweight is disposed behind the revolving frame along the second direction.

5. The mining shovel of claim 1, further comprising a rear cab and an air filtration unit coupled to and disposed above the revolving frame along the direction, wherein the direction is a first direction, and wherein the center of gravity of the counterweight is disposed behind the rear cab and the air filtration unit along a second direction that is perpendicular to the first direction.

6. The mining shovel of claim 5, wherein the entire counterweight is disposed behind the rear cab and the air filtration unit along the second direction.

7. The mining shovel of claim 1, wherein the thrid memeber is a line coupled between the actuator and the counterweight, wherein the actuator changes a position of the counterweight by adjusting a length of the line.

8. The mining shovel of claim 1, wherein the counterweight includes a bottom wall, and wherein the bottom wall of the counterweight is disposed at a height of at least 32 feet above the plane along the direction during both operation and rest of the mining shovel.

9. The mining shovel of claim 1, wherein the actuator is a hoist drum, or a power-operated sheave or winch.

10. The mining shovel of claim 1, wherein the actuator is coupled to a gantry junction between a grantry tension member and a gantry compression member.

* * * * *